United States Patent [19]

Wagman

[11] 3,967,275

[45] June 29, 1976

[54] ANTENNA MOUNT FOR VEHICLES

[76] Inventor: Harold H. Wagman, 370 Lakeview Drive, York, Pa. 17402

[22] Filed: Oct. 28, 1975

[21] Appl. No.: 626,345

[52] U.S. Cl. ..... 343/713; 343/715
[51] Int. Cl.[2] ..... H01Q 1/32
[58] Field of Search ..... 343/713, 715

[56] References Cited

UNITED STATES PATENTS

| | | | |
|---|---|---|---|
| 2,946,842 | 7/1960 | Chadowski | 343/713 |
| 3,408,652 | 10/1968 | Allisbaugh | 343/715 |
| 3,710,339 | 1/1973 | Rima | 343/715 |
| 3,899,148 | 8/1975 | Fleming | 343/715 |

*Primary Examiner*—Harold A. Dixon
*Attorney, Agent, or Firm*—C. Hercus Just

[57] ABSTRACT

A clamp-type mount adapted to be clamped to an outwardly extending rod-like member such as a rear view supporting arm projecting from one side of the cab of a truck and including a pair of similar clamping members having opposed grooves in the adjacent faces of the clamping member to receive said rod-like member, and one of said clamping members having a seat formed thereon for the reception of an electrical insulating coupling member which is attached by a short threaded rod member to said one clamping member against said seat therein and the outer end of said coupling member being threaded to receive a threaded end of a metallic antenna rod and clamp a metallic connector against the outer end of the insulating coupling member for connection of a hot wire thereto.

8 Claims, 7 Drawing Figures

ANTENNA MOUNT FOR VEHICLES

BACKGROUND OF THE INVENTION

The mounting of radio antennas on vehicles such as trucks and the tractor members of tractor-trailer combinations has become very popular in view of the use of citizen band radios by which the drivers of such vehicles can be kept in communication with home offices, dispatchers, and other personel as well as other vehicle drivers. Various types of awkward and make shift clamping members for the antennas are used in a number of installations to mount the antennas at various locations upon the cabs, for example, of such vehicles and many of these are ineffective for purposes of securely mounting and supporting the antennas relative to the vehicles and particularly in a manner to insulate the antennas from the metal parts of the vehicle.

It is possible to provide permanently attached brackets to the cabs of vehicles as well as upon other locations upon the vehicle but this requires making holes in the supporting means on the vehicle and this is undesirable, particularly when it is desired to remove the antenna and the bracket, with the result that the holes in the supporting surface are visible.

Certain service vehicles such as police cars, ambulances and the like also are equipped with radio antennas of a substantial type and many of these are mounted either upon the rear bumper of the vehicle or upon one side of a rear fender. The bumper type antenna usually employs a pair of clamping claws which engage upper and lower edges of the bumper, while the brackets attached to one side of a rear fender of the vehicle are of a permanently attached type requiring the making of holes in the fender as referred to above. Other installations also have been made upon such vehicles by mounting the same upon the roof of the cab or body of the vehicle and these also have included the making of holes in the supporting surfaces, all of which is objectionable, especially after the antenna is dismounted for any purpose.

SUMMARY OF THE INVENTION

It is the principal object of the present invention to provide a simple, strong, durable and effective clamp comprising a pair of similar clamping members having grooves in opposed clamping faces thereof which respectively receive opposite surfaces of an outwardly extending rod-like supporting member such as a bracket arm for rear view mirrors of the type used on the sides of truck cabs and the like which are permanently attached in firm manner to the side of the cab, thereby offering a highly suitable support member, one of said clamping members having a seat in the upper surface thereof which receives an insulating coupling member having a threaded upper end to which the threaded lower end of a vertical, metallic radio antenna is connected in spaced relationship to any metallic portion of the clamping means, whereby a hot wire connector may easily and effectively be clamped between the threaded end of the antenna and the upper end of said insulating coupling member, while a ground wire may be connected to one of the metallic clamping members at a suitable location upon the vehicle.

Another object of the invention is to provide a bore in the upper clamping member to which said insulating coupling member is connected, said bore being threaded to receive a short threaded metallic connector which projects above the seat in said clamping member and is threaded into the lower end of said insulating coupling member to firmly connect the lower end thereof against said seat in said clamping member in a very simple but highly effective manner, the upper end of said threaded connector being spaced from the lower end of the metallic antenna rods so as to be insulated therefrom.

A further object of the invention is to provide the lower end of the radio antenna with a geometrical configuration in cross section, such as hexagonal, to facilitate engagement thereof with a wrench and the threaded extremity of said antenna rod being circular, thereby providing a shoulder at the junction of said threaded end with said geometrical configuration of the rod, said shoulder being employed to effectively clamp said aforementioned apertured metallic connector for a hot wire between said insulating coupling member and said metallic antenna rod in a manner to insulate the hot wire connector from the clamping members.

Details of the foregoing objects and of the invention, as well as other objects thereof, are set forth in the following specification and illustrated in the accompanying drawings comprising a part thereof.

DETAILED DESCRIPTION

Figure 1:
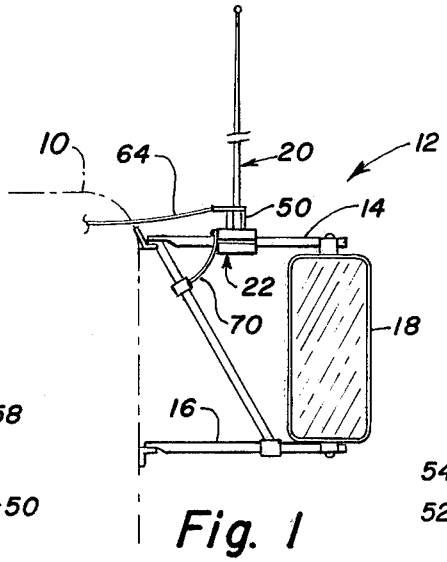
FIG. 1 is a fragmentary vertical elevation of an installation illustrating a typical example of antenna mount embodying the principles of the invention and shown as being attached to a horizontal mirror supporting rod of a truck cab which is shown in phantom.

Referring to FIG. 1, a phantom outline 10 of one side of the cab of a vehicle such as a motor truck is shown, said side supporting a bracket structure 12 having upper and lower parallel arms 14 and 16 by which a rear view mirror 18 is supported at opposite ends. One of said arms provides a very convenient support for an antenna or aerial 20 of the type frequently used on commercial vehicles, for example, for use with citizen band radios that afford either one way or two way communication between the driver of the vehicle and another vehicle, dispatching office, or otherwise. Suitable clamping means for supporting such antenna or aerial 20 upon such vehicle has largerly been left to chance which has resulted in many types of somewhat makeshift clamping devices to support such aerials. The purpose of the present invention however is to provide a simple, but highly effective and structurally strong antenna support 22 which is readily attachable to one of the mirror supporting arms, FIG. 1 illustrating the same being attached to the upper arm 14. Details of said support 22 are as follows.

Support 22 primarily consists of a pair of similar clamping members 24 and 26. For purposes of pleasing appearance as well as providing a smooth exterior surface, said clamping members, in cross section, are semi-circular and the length of said members is preferably substantially equal to the diameter of the members. These members preferably are made from suitable metal such as steel and, for aesthetic purposes, as well as to render them rust proof, the same are finished by applying a coating of chromium or other suitable plating metal thereto or, the same may be made from aluminum and polished to a pleasing surface. Thus, the members 24 and 22 have a curved outer surface and the opposing clamping surfaces 28 and 30 thereof are substantially planar and, in use, preferably are parallel to each other.

Figure 2:
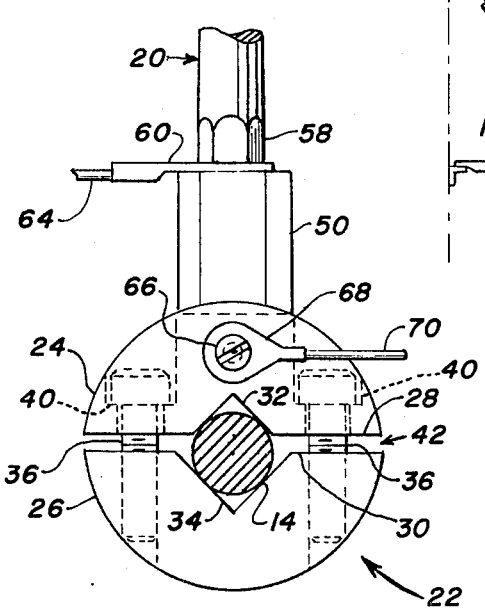
FIG. 2 is a vertical end view of one end of the clamp type mount comprising the present invention, the antenna not being present in said figure.
Figure 4:
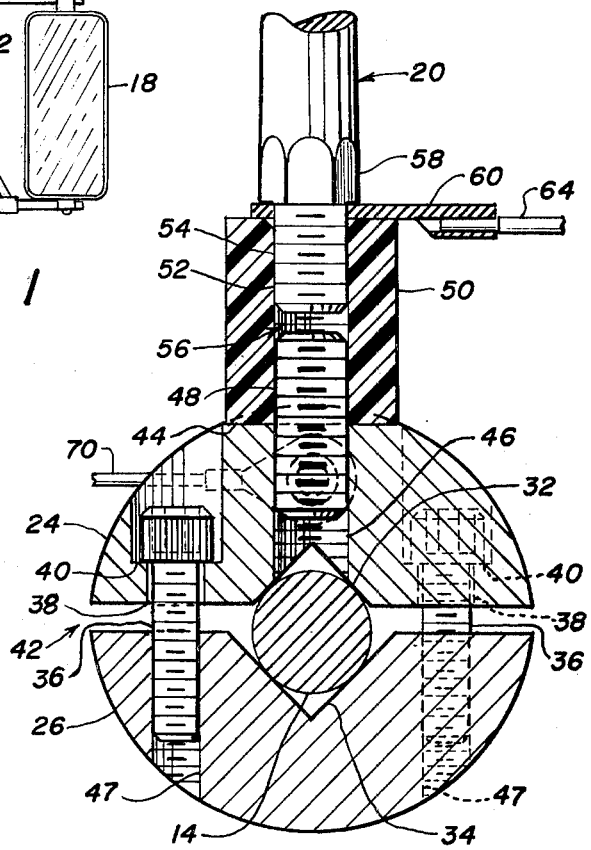
FIG. 4 is an enlarged vertical sectional view of the mount illustrated in FIG. 3 as seen on the line 4—4 thereof, the upper end of said figure illustrating a fragmentary lower portion of a typical metallic antenna rod.

For purposes of providing effective engagement of the clamping members with one of the mirror supporting arms, for example, such as arm 14, it will be seen from FIGS. 2 and 4 in particular, that centrally of each clamping surface 28 and 30 and extending for the full length thereof, there is an arm-engaging clamping groove, the groove in clamping member 24 being identified as groove 32, while the groove in clamping member 26 is identified as groove 34. It will be seen that the groove 34 is larger than groove 32 and this difference is purposeful by rendering these grooves more universal than otherwise for purposes of tightly engaging a variety of different types of supporting members such as not only rods which support a rear vision mirror but rods of other types which are employed for various purposes on vehicles of different kinds which have need for supporting a radio antenna. In FIGS. 2 and 4 however, the upper arm 14 shown in FIG. 1 is employed for illustrative purposes to show an exemplary clamping function of the grooves 32 and 34.

Figure 3:
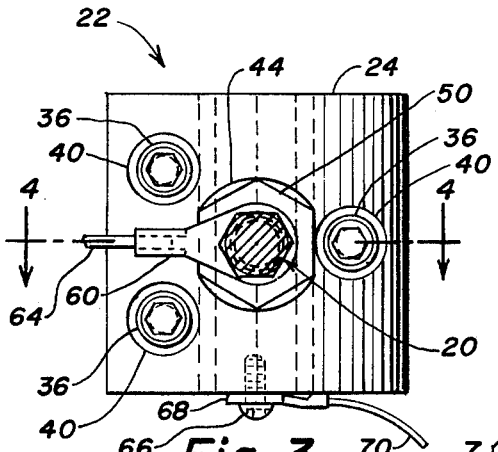
FIG. 3 is a top plan view of the mount shown in FIG. 2.
Figure 5:
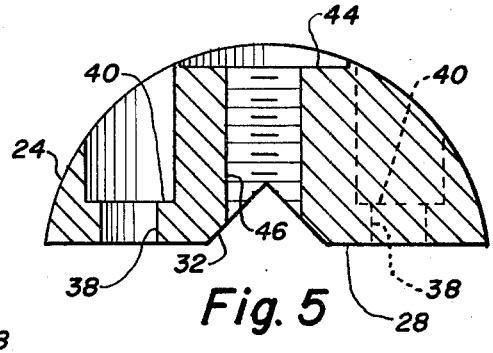
FIG. 5 is a vertical sectional view of the upper clamping member of the mount illustrated in FIGS. 2–4, as seen along the line 4—4 of FIG. 3.

The clamping members 24 and 26 are secured in clamping relationship by a plurality of bolts 36 which, for example, may be of the Allen type and the same extend through appropriate holes 38 formed, for example, in triangularly spaced relationship to each other, as shown in FIG. 3 in exemplary manner, within the clamping member 24. Axially aligned holes 47, which are tapped to receive the threads of screws 36, are formed in the other clamping member 26. From FIG. 4 and FIG. 5, it also will be seen that the clamping member 24 is provided with suitable seats 40 which are complementary to the heads of the bolts 36 and permit the heads to be recessed a substantial distance into the interior of the clamping member 24 to minimize projections when the clamping members are secured in operative position. It also will be understood that normally, there is a slight space 42 between the clamping surfaces 28 and 30 of the clamping members in order to insure firm engagement of the clamping grooves 32 and 34 with a supporting member such as arm 14.

The upper clamping member 24 also is provided with an additional seat 44 which is milled into the upper curved surface of said member, diametrically opposite the clamping groove 32 therein and mid-way of the opposite ends of the clamping member 24. Centrally of said seat, there is also a threaded bore 46 which intersects both said seat 44 and clamping groove 32. The bore 46 threadably receives one end of a threaded connector 48 which preferably is metallic such as steel, brass, or otherwise. As shown in FIG. 4, the lower end of connector 48 should not project any substantial distance into the groove 32 and the upper end thereof projects only a limited distance above the seat 44, for purposes to be described.

The present invention also includes an antenna coupling member 50 which is formed from suitable insulating material, such as an appropriate plastic or synthetic resin material of a substantially firm, relatively hard nature in order that the same may be provided with a central bore 52, at least the opposite ends of which are threaded respectively to threadably receive the upper end of the threaded connector 48 which extends into the lower end of bore 52 of coupling member 50 and the upper end of said threaded bore receives a threaded end 54 on what is the lower end of radio antenna 20 when the same is mounted in use. The threaded end 54 of the antenna is only of limited length in order that when the same is fully threaded into the upper end of the bore 52 of coupling member 50, there will be an insulating space 56 provided in the bore 52 between the opposing ends of the threaded end of 54 of antenna 20 and the upper end of threaded connector 48, as clearly shown in FIG. 4.

The exterior surface of coupling member 50 preferably is geometrical in cross section, such as hexagonal, in order that a wrench might be used to firmly thread the same onto the upper end of threaded connector 48 and into tight engagement with the additional seat 44 so as to firmly secure the antenna coupling member 50 to the clamping member 24.

Figure 7:
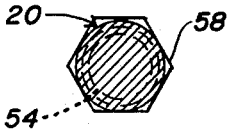
FIG. 7 is a transverse sectional view of the lower end of the antenna as seen on the line 7—7 of FIG. 6.
Figure 6:
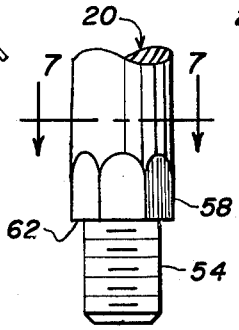
FIG. 6 is a fragmentary vertical elevation of the lower end portion of the typical antenna rod shown in FIG. 4 and particularly showing the shoulder formed thereon between the threaded terminal portion and the hexagonal lower portion immediately adjoining said threaded portion.

At least the lower end 58 also is geometrical in cross section, such as shown in FIG. 7 in order that a wrench might be employed to tightly thread the lower threaded end 54 of the antenna into the threaded upper end of bore 52 of coupling member 50 and, in so doing, this clamping function is employed for the additional purpose of securing an electrical terminal grommet 60 which is apertured with a hole of a suitable diameter to receive the threaded end 54 of antenna 20 and due to the fact that said threaded end is circular in cross section and is machined into such condition from the hexagonal shape of the lower end 58 of the antenna 20, a shoulder 62 is provided on said lower hexagonal end 58 of the antenna which firmly abuts the upper surface of grommet 60 incident to tightly threading the threaded end 54 of the antenna into the threaded bore of the coupling member 50 and thereby not only tightly secures the grommet to the assembly but establishes electrical connection in a metal-to-metal contact between the antenna 20, which is formed of metal, and the grommet 60 which also is if metal. Due to the fact however that they are both connected to an electrical insulating coupling member 50, a wire 64, which is a "hot" wire that is connected from the radio unit to the aerial will not be grounded.

The antenna mount also is provided with electrical grounding means in the form of a convenient screw 66 which is threaded, for example, into one end of one of the clamping members, such as clamping member 24 as shown in FIGS. 2 and 3, said screw also securing another electrical metallic grommet 68 to said metallic clamping member for purposes of securing a ground wire 70 to the antenna mount and thereby provide the necessary rudiments of an electrical circuit to the antenna support 22.

From the foregoing, it will be seen that the present antenna mount comprises a relatively simple structure which may be easily manufactured and assembled with the use of relatively simple tools so that no professional assistance is required to attach the same to a supporting member of a vehicle, whether automotive or otherwise, in order that a radio antenna 20 may be supported thereby in firm manner and in electrically insulated manner from the arm or other means to which the mount is clamped.

While the invention has been described and illustrated in its several preferred embodiments, it should be understood that the invention is not to be limited to the precise details herein illustrated and described since the same may be carried out in other ways falling within the scope of the invention as illustrated and described.

I claim:

1. A clamp-type mount for supporting the base end of an elongated antenna upon a projecting rod-like member on a vehicle and adapted to support said antenna substantially vertically upon said projecting rod-like member, said mount comprising in combination, a pair of complementary clamping members each having similar clamping surfaces opposing each other, said surfaces each having a groove therein extending between opposite ends thereof and V-shaped in cross-section and adapted to engage respectively opposite surfaces of a rod-like structional member for support thereby, said clamping members having a plurality of aligned holes therein, a plurality of clamping bolts extending through said aligned holes between said clamping members to tightly clamp said members to said rod-like structural member, one of said clamping members also having a seat formed on a surface thereof opposite said groove therein, an antenna coupling member formed from electrical insulating material and having one end in abutment with said seat on said one clamping member, said coupling member having an axial bore therethrough and at least the opposite ends of said bore being threaded, said one clamping member also having a bore extending therethrough between said seat and groove perpendicularly to the axis of said groove, a threaded connector having one end secured within said bore in said one clamping member and projecting beyond said seat and firmly threadably engaging the threads in one end portion only of said coupling member to secure it firmly against said seat, means to connect a ground wire to said one clamping member, and an apertured metallic connector adapted to receive a threaded end of an aerial rod to firmly clamp said metallic connector to said insulating antenna coupling member in spaced relation to the end of said threaded connector therein and securely clamp said apertured metallic connector against the outer end of said insulating antenna coupling member for insulated support thereby upon said one clamping member.

2. The mount according to claim 1 in which said means to connect a ground wire to said one of said clamping members comprises a screw threaded into one end of said one clamping member.

3. The mount according to claim 1 in which said clamping members are semi-circular in cross section and said seat in said one of said clamping members is recessed into the curved exterior surface of said member in opposition to the groove therein.

4. The mount according to claim 1 in which the groove in one of said clamping members is larger than the groove in the other clamping member to accommodate support rods of a range of different sizes and shapes.

5. The mount according to claim 1 in which the end of the axial bore in said insulating coupling member which is opposite the end which abuts said seat therefor is chamferred to minimize the possibility of an antenna rod being ruptured at said end of said bore.

6. The mount according to claim 1 in combination with a metallic antenna rod having one end threaded in complementary manner to the threads in said insulating coupling member, and said threaded end of said antenna rod having a shoulder formed thereon to engage said apertured metallic connector and clamp the same firmly against said rod for electrical connection therewith, said metallic connector being adapted to be connected to a source of electrical current.

7. The mount according to claim 6 in which said threaded end of said antenna rod is of limited length less than the distance from the outer end of said threaded bore in said insulating coupling member to the end of the threaded connector therein and thereby provide a space between said antenna rod and threaded connector operable to serve as electrical insulating means.

8. The mount according to claim 6 in which at least the threaded end of said antenna rod is geometrical in cross section to provide opposing surfaces adapted to be engagable by a wrench and said threaded end of said antenna rod being circular in cross section, thereby to provide said aforementioned shoulder to engage and clamp said metallic connector against said insulating coupling member.

* * * * *